United States Patent [19]

Kurtz

[11] 4,356,580

[45] Nov. 2, 1982

[54] SHOWCASE LOCK FOR SLIDING DOORS

[76] Inventor: Thomas D. Kurtz, 1101 First Ave., Rock Falls, Ill. 61071

[21] Appl. No.: 198,434

[22] Filed: Oct. 20, 1980

[51] Int. Cl.[3] ..... E05B 17/04; E05B 65/08

[52] U.S. Cl. ..... 70/14; 70/95; 70/379 R

[58] Field of Search ..... 70/14, 95, 99, 100, 70/379 R, 380, 417, 455; 292/151

[56] References Cited

U.S. PATENT DOCUMENTS

| | | | |
|---|---|---|---|
| 2,050,696 | 8/1936 | Schoorel . | |
| 2,114,913 | 4/1938 | Grossman | 70/455 |
| 2,172,208 | 9/1939 | Kurtzon . | |
| 2,878,663 | 3/1959 | Smith . | |
| 3,262,292 | 7/1966 | Glass | 70/14 |
| 3,499,209 | 3/1970 | Laviane | 70/417 |
| 3,931,723 | 1/1976 | Kurtz . | |

*Primary Examiner*—Robert L. Wolfe
*Attorney, Agent, or Firm*—Vernon J. Pillote

[57] ABSTRACT

A showcase lock for sliding doors including a keeper plate attached to one door and a lock adjustable along the keeper plate to lock the doors in a closed position. The keeper plate has inwardly directed flanges along opposite side edges defining opposed grooves and a row of stops between the flanges and the lock has outwardly directed flanges along opposite side edges slidably receivable in the opposed grooves on the keeper plate. The lock has a rotary key operated plug, a cam on the inner end of the plug, and a resilient U-shaped latch member mounted for rocking movement about an axis crosswise of the plug between a locked and an unlocked position.

19 Claims, 8 Drawing Figures

SHOWCASE LOCK FOR SLIDING DOORS

BACKGROUND OF THE INVENTION

The present invention relates to a showcase lock for by-pass type sliding doors such as the sliding glass doors used in glass showcases. Such showcase locks generally include an elongated keeper that can be attached to the inner door and a separate lock member that is adjustable along the keeper to lock the doors in a closed position. Showcase locks of the type shown in U.S. Pat. Nos. 2,050,696; 2,172,208 and 2,878,663 require some clearance between the keeper and the inner panel to allow mounting of the lock on the keeper, and the keepers in these patents are attached at only one end by a clip or clamp to the edge portion of the inner closure panels. Clip-on type keepers can move or shift relative to the inner door and present problems not only because they can become tilted or even dislodged from the inner door during installation, but also because they can cause chipping of the edges of glass doors, if they are not properly positioned when the lock is installed. My prior U.S. Pat. No. 3,931,723, discloses a showcase lock in which the keeper is adhesively secured along its entire back side to the face of the inner panel so that it cannot move or shift relative to the inner panel. However, my prior patent required a special plunger type lock in which the lock plug could be moved both axially and rotationally to first shift the latch toward the keeper and then turn the latch into locking engagement with flanges on the keeper.

It is an object of this invention to provide a showcase lock having an improved arrangement for slidably mounting the lock on the front side of the keeper for locking in adjusted positions therealong whereby the back side of the keeper can be adhesively bonded to the face of the door.

Another object of this invention is to provide a showcase lock for sliding doors in which the keeper has a row of stops intermediate its side edges and the lock has an improved latch and latch actuator for moving the latch into and out of engagement with the stops in response to turning of a key operated plug.

Still another object of this invention is to provide a showcase lock for sliding doors in which the lock is movably retained by a chain on one of the doors when not in use.

Other objects of this invention are to provide a showcase lock for by-passing type doors which can be economically manufactured, which can be easily installed on the doors without use of tools, and which substantially eliminate chipping or breaking of glass type closure panels by the showcase lock.

Further objects of the invention will be apparent from the following description when taken in connection with the accompanying drawings wherein.

Figure 1:
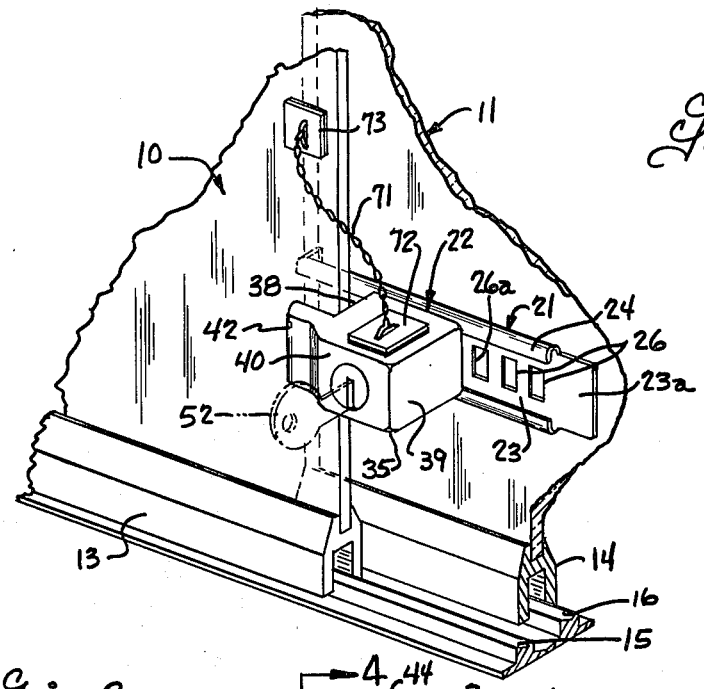
FIG. 1 is a fragmentary perspective view of a showcase embodying the present invention and shown mounted on a pair of by-passing type doors.

The lock of the present invention is generally adapted for use on by-passing type doors and particularly for use on sliding glass doors of the type commonly used in glass showcases and the like. The lock is shown applied to outer and inner by-passing type doors 10 and 11 which are respective slidable on outer and inner parallel tracks. Various different trackways can be used to slidably support the by-passing type doors, some of which trackways are arranged to directly receive the edges of the doors and the others of which trackways are arranged to receive frame members on the edges of the doors. In the embodiment illustrated, metal frame members 13 and 14 are attached to the outer and inner doors 10 and 11 respectively and contain rollers (not shown) which engage outer and inner trackways 15 and 16 to slidably support the doors for endwise movement. Trackways are also provided at the upper edges of the doors to maintain the same in spaced parallel relation and the upper trackways are usually in the form of downwardly opening channels that slidably receive either the edge of the doors or frames attached to the doors. The details of construction of the trackways for slidably supporting the doors forms no part of the present invention and further detailed description and illustration is deemed unnecessary.

The showcase lock in general includes a keeper 21 which is mounted on the inner door 11 and a lock 22 which is slidably mounted on the keeper and engageable with the edge of the outer door 10, to lock the doors in a closed position. The keeper 21 is in the form of an elongated plate 23 having a pair of keeper flanges 24 along opposite side edges and projecting inwardly toward each other and spaced from the side of the keeper plate to define a pair of opposed lengthwise extending grooves 25 that open toward each other. The keeper plate has a row of stops located substantially medially between the side edges and, in the preferred embodiment shown, the plate has a row of openings 26 at spaced locations therealong which are separated by intermediate bar segments **26*a* providing the aforementioned stops. The keeper has transversely extending flange 28 at one end engageable with the edge of the inner door 11 to aid in locating the keeper on the inner door and to also provide a positive abutment to limit movement of the keeper in a direction away from the edge of the inner door. The keeper plate is longer than the keeper flanges to provide a plate portion 23*a* at the end of the keeper remote from the flange 28, which plate portion extends beyond the end of the keeper flanges and is coplanar with the remainder of the keeper plate for guiding the lock into the grooves in the keeper plate. In the preferred embodiment illustrated, the keeper plate is adhesively bonded to the inner panel 11 to remain permanently affixed to the panel. The adhesive is preferably in the form of a double sided pressure sensitive adhesive tape indicated at 30**. Alternatively, an adhesive coating could be applied directly to the attaching face of the mounting plate. The actual thickness of the adhesive layer has been exaggerated somewhat in the drawings for the purpose of illustration, and the adhesive layer is preferably made only sufficiently thick to accommodate minor irregularities and to assure a good bond between the mounting plate and door.

Figure 2:
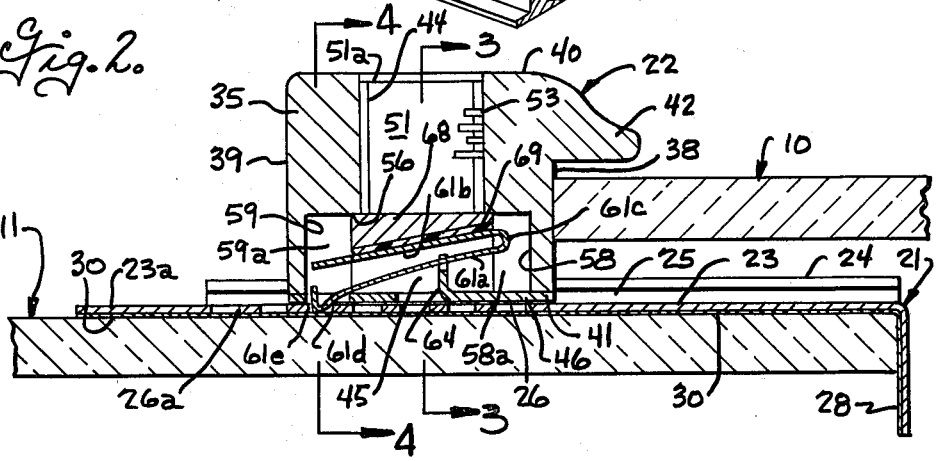
FIG. 2 is a fragmentary horizontal sectional view showing the lock and keeper applied to by-passing type doors.
Figure 3:
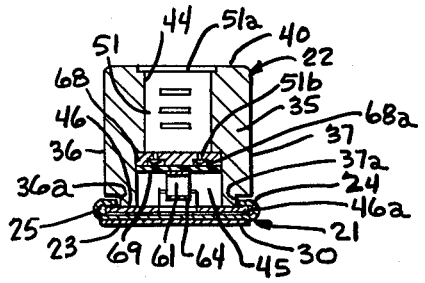
FIG. 3 is a transverse sectional view taken on the plane 3—3 of FIG. 2.
Figure 4:
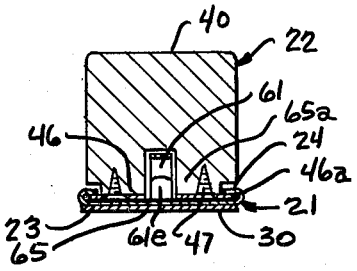
FIG. 4 is a transverse sectional view taken on the plane 4—4 of FIG. 2.

The lock 22 includes a housing 35 that is adapted to be slidably mounted on the keeper 21. The housing is conveniently formed by molding and, as shown, has a generally rectangular configuration with opposed side walls 36, 37, opposed end walls 38, 39, top wall 40 and bottom wall 41. A lip 42 is preferably provided to extend laterally from the end wall 39 and spaced from the bottom wall 41 a distance sufficient to overlie the outer face of the outer panel 10, when the lock is mounted on the keeper as shown in FIG. 2. The housing has a plug bore with its axis perpendicular to the bottom wall 41 and a lock cavity 45 at the inner end of the plug bore. A face plate 46 is attached by fasteners 47 to the bottom wall of the lock housing and extends across the lock cavity 45. The face plate is preferably formed of a thin metal plate and opposite edge portions 46*a* of the face plate extend outwardly of the adjacent side wall portions of the lock housing to provide a pair of parallel housing flanges disposed in a common plane and projecting outwardly from each other. The face plate 46 has a thickness slightly less than the depth of the grooves 25 to be slidably received therein. As best shown in FIGS. 3 and 4, the side walls 36 and 37 have lower portions 36*a* and 37*a* that are offset inwardly from the main portion of the side walls, to provide clearance for the keeper flanges 24. While the lock housing can be molded of metal, it is preferably molded of an impact resistant plastic to reduce the likelihood of chipping or breaking the edge of the glass when it abuts against the outer panel 10, and to also reduce the overall weight. The housing may, for example, be molded of ABS plastic which can be coated as by vapor plating in different colors such as gold, bronze, alumninum.

A key operated plug 51 is mounted in the plug bore 44 for turning movement under the control of a key 52. The plug can be either of the disk tumbler or pin tumbler type and is herein shown of the disk tumbler type having a plurality of disks 53 mounted therein for movement cross-wise of the plug and having projections 53*a* adapted to engage longitudinally extending grooves 44*a* and 44*b* in the plug bore, when the plug is in its lock and unlock positions respectively. The disk tumblers are yieldably biased outwardly by springs (not shown) to engage the grooves in the plug bore and lock the plug against turning. The disks are retracted into the plug when the proper key is inserted into the plug so that the lock plug can be turned between its lock and unlock positions.

The plug has a peripheral rim 51*a* at its outer end rotatably received in a complementary groove in the outer end of the plug bore, to limit inward movement of the plug. The lock cavity 45 has a somewhat larger cross-section than the plug bore to define a shoulder 56 at the inner end of the plug bore. The lock cavity is preferably of generally circular cross-section with recesses 58 and 59 at opposite sides of the lock cavity defining relatively parallel guide walls 58*a* and 59*a* respectively disposed perpendicular to the lower end face 41 of the lock housing. A latch is provided in the lock cavity and comprises a generally U-shaped spring member 61 conveniently formed of flat spring steel stock and having an elongated latch arm 61*a* and an elongated actuator arm 61*b* interconnected by a bight portion 61*c*. The free end of the latch arm terminates in a latch nose having a cam face 61*d* and an abutment face 61*e*. The U-shaped spring member is mounted in the plug cavity with the actuator arm 61*b* extending crosswise of the axis of the plug bore adjacent the inner end of the plug 51 and with the ends of the actuator arm extending into the recesses 58 and 59 to be guided by the spaced walls 58*a* and 59*a* respectively. The latch arm 61*a* also extends crosswise of the axis of the plug bore and is spaced relatively farther from the inner end of the key operated plug, and a fulcrum 64 is provided for mounting the latch arm for rocking movement about an axis intermediate the ends of the latch arm and crosswise of a plane through the latch and actuator arms. The fulcrum 64 is conveniently formed by striking a tab from the face plate and bending it upwardly to a level above the face plate to form a fulcrum at the upper edge thereof. The tab is preferably notched to provide projections at opposite ends of the fulcrum for laterally retaining the latch arm in position. An opening 65 is provided in the face plate adjacent the free end of the latch arm to allow the latch nose to move into and out of the lock cavity.

Figure 5:
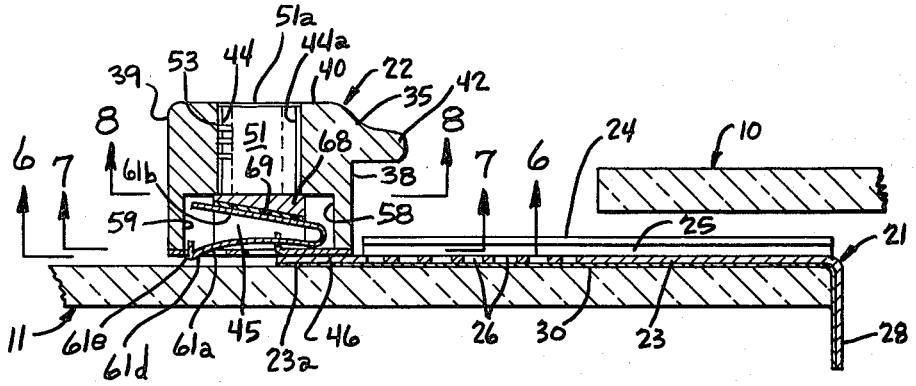
FIG. 5 is a fragmentary horizontal sectional view illustrating mounting of the lock on the keeper.
Figure 6:
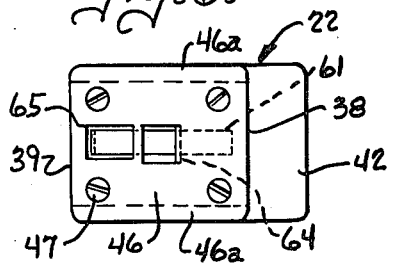
FIG. 6 is a bottom plan view of the lock taken on the plane 6—6 of FIG. 5.
Figure 7:
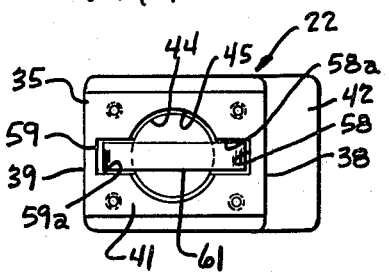
FIG. 7 is a sectional view taken on the plane 7—7 of FIG. 5.
Figure 8:
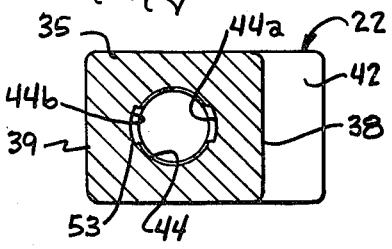
FIG. 8 is a sectional view taken on the plane 8—8 of FIG. 5.

A cam 68 is provided on the inner end of the key operated plug and engages the actuator arm 61*a* to rock the actuator arm and latch arm between a lock position as shown in FIG. 2 and a release position as shown in FIG. 5. The cam member 68 is attached to the inner end of the key operated plug 51 for turning therewith and, conveniently, the plug 51 can be formed with integral projections 51*b* (FIG. 3) at its inner end that extend into countersunk openings 68*a* in the cam member and which can be riveted or spun over to provide head as shown in FIG. 3 for retaining the cam member on the plug. The cam member can be formed of metal or a suitable plastic material such as ABS and preferably has a diameter larger than the diameter of the plug bore to engage the shoulder 56 and limit outward movement of the plug. The cam member 68 has a cam face 68*a* that is inclined at an acute angle to the axis of the plug and a disk 69 is preferably interposed between the cam face and the actuator arm 61*b* to prevent direct rubbing contact between the cam and actuator arm. The disk is conveniently formed of the same material as the housing to allow free rotation of the cam relative to the disk. As will be seen, when the key operated plug is in its lock position shown in FIG. 2, the actuator arm is tilted downwardly toward the nose end of the latch arm and the latch arm is correspondingly rocked about the fulcrum 64 to its latch position in which the latch nose extends through the opening 65 in the face plate. When the plug is in its lock position, the latch nose is yieldably biased outwardly of the face plate and will project into an opening in the keeper plate that is aligned therewith. The latch arm will yield and the cam face on the latch nose will cam the latter out of the opening in the keeper plate, when the lock is pushed toward the edge of the outer door, that is to the right as shown in FIG. 2, so that the latch member will allow the lock to "rachet" into its fully locked position. The stop face on the latch nose, however, provides a sharp abutment which engages the cross bars between adjacent openings to prevent retrograde movement, that is movement of a lock toward its release position. When a key is inserted into the plug, it can be turned to its release position shown in FIG. 5 in which the cam 68 tilts the actuator arm 61*b* downwardly in a direction away from the latch nose 65, to thereby rock the latch arm in a direction to raise the latch nose as shown in FIG. 5. When the latch nose is retracted into the lock cavity, the lock housing can be moved along the keeper in a direction away from the outer panel to disengage the lock housing from the keeper.

The lock 22 is completely separable from the keeper plate 21 and provision is advantageously made for movably retaining the lock on the outer door 10, when the lock is not in use. As best shown in FIG. 1, an elongated flexible element such as a chain 71 is provided with pads 72 and 73 at its opposite ends. One pad 73 has a generally flat mounting face for mounting on the outer panel 10 and a pressure sensitive adhesive is applied to the mounting face to facilitate attachment of the pad to the outer panel. The other pad is shaped to conform to a wall portion on the lock housing 22. In the embodiment illustrated, the lock housing has flat side walls and the pad 72 is made flat, it being apparent that the pad 72 could be formed with an arcuate configuration for use with lock housings having a cylindrical side wall. The pressure sensitive adhesive is preferably provided by a double faced pressure sensitive adhesive tape which is affixed to the respective pad face. A release covering is provided on the outer face of the pressure sensitive adhesive tape and which can be removed prior to installation.

From the foregoing it is thought that the construction and use of the lock will be readily understood. The keeper plate is adhesively bonded to the inner door 11 and is intended to remain permanently attached to the inner door. This avoids shifting of the keeper plate relative to the inner door and minimizes the likelihood of chipping or breaking of the glass. The keeper plate provides inwardly opening grooves at its outer side and the keeper plate extends beyond the channels so that the lock can be positioned against the extending end portion of the keeper plate to facilitate guiding of the lock flanges into the channels on the keeper plate. The lock is advantageously formed of an impact resistant plastic material to minimize the likelihood of chipping or breaking the glass of the outer panel, and to also reduce overall weight so that it is less likely to break the glass when suspended by a flexible retainer such as 71. The generally U-shaped latch member is mounted so that it can tilt or rock about a pivot axis that extends crosswise of the plug bore, and the cam on the plug engages the actuator arm **61*b* to move the same between a lock position in which the actuator arm is inclined downwardly toward the latch nose as shown in FIG. 2, and a release position in which the actuator arm is inclined downwardly in a direction away from the latch nose as shown in FIG. 5. When in its lock position, the latch arm is resiliently biased in a direction outwardly of the housing, but the latch arm can cam over the abutments on the keeper when the lock is moved toward its lock position against the outer panel 10**. The latch nose, however, provides a sharp abutment which prevents retrograde movement of the lock, until the key operated plug is rotated to its unlock position.

The embodiments of the invention in which an exclusive property or privilege is claimed are defined as follows:

1. A lock for use on by-passing type doors to lock the doors in a closed position with adjacent end portions to the doors in spaced overlapping relation, the lock comprising, an elongated keeper plate, means for mounting the keeper plate on one of the doors with one side of the plate overlying one face of that door, a pair of keeper flanges along opposite side edges of the keeper plate projecting inwardly toward each other and spaced from the other side of the keeper plate to define a pair of opposed lengthwise extending grooves at said other side of the keeper plate opening toward each other, means defining a row of stops at said other side of the keeper plate intermediate the keeper flanges, a lock housing having means defining a pair of parallel housing flanges fixed to the housing and disposed in a plane at one side of the housing and projecting outwardly away from each other and dimensioned to be slidably received in the pair of lengthwise extending grooves in the keeper plate to slidably support the housing on the keeper plate, the lock housing being engageable with an edge of the other door when the housing flanges are disposed in the grooves in the keeper plate, latch means at said one side of the housing intermediate said housing flanges and adapted to engage said stops on the keeper plate, a key operated plug mounted for turning only in said lock housing, and means responsive to turning of said key operated plug for moving said latch means relative to the housing flanges in a direction transverse to the plane thereof between a latch position for engaging the stops and a release position for disengaging the stops.

2. A lock according to claim 1 wherein said keeper plate is longer than said keeper flanges to provide a plate portion extending beyond the end of the keeper flanges and coplanar with the keeper plate for guiding the housing flanges into said grooves.

3. A lock according to claim 2 wherein said keeper plate has a row of openings at spaced locations therealong providing said stops intermediate adjacent openings.

4. A lock according to claim 3 wherein said means for mounting the keeper plate includes pressure sensitive adhesive means on said one side of the plate adapted to adhesively bond to the face of said one door.

5. A lock for use on by-passing type doors to lock the doors in a closed position with adjacent end portions to the doors in spaced overlapping relation, the lock comprising, an elongated keeper plate, means for mounting the keeper plate on one of the doors with one side of the plate overlying one face of that door, a pair of keeper flanges along opposite side edges of the keeper plate projecting inwardly toward each other and spaced from the other side of the keeper plate to define a pair of opposed lengthwise extending grooves at said other side of the keeper plate opening toward each other, means defining a row of stops at said other side of the keeper plate intermediate the keeper flanges, a lock housing having means defining a pair of parallel housing flanges disposed in a plane at one side of the housing and projecting outwardly away from each other and dimensioned to be slidably received in the pair of lengthwise extending grooves in the keeper plate, the lock housing being engageable with an edge of the other door when the housing flanges are disposed in the grooves in the keeper plate, said lock housing having a plug bore therein disposed perpendicular to the plane of said housing flanges and a lock cavity at the inner end of said plug bore, a key operated plug mounted for turning in said plug bore, latch means at said one side of the housing intermediate said housing flanges and adapted to engage the stops on the keeper plate, said latch means including a generally U-shaped spring member having a latch arm and an actuator arm resiliently interconnected at one end by a bight portion, means mounting said U-shaped spring member in the lock cavity with the actuator arm extending crosswise of the axis of the plug bore adjacent the inner end of the key operated plug and with the latch arm extending crosswise of the axis of the plug bore and spaced relatively farther from the inner end of the key operated plug, means mounting said latch arm on the lock housing for rocking movement about an axis intermediate its ends and crosswise of a plane through latch arm and actuator arm, and cam means on the end of the key operated plug engageable with the actuator arm for tilting the actuator arm in response to turning of the key operated plug to move the latch means between a latch position for engaging the stops and a release position for disengaging the stops.

6. A lock according to claim 5 wherein the lock housing has a recess intersecting said lock cavity adjacent said one side of the housing and defining spaced walls disposed perpendicular to said one side of the housing and engageable with the actuator arm for guiding the actuator arm during tilting movement thereof.

7. A lock according to claim 5 wherein said housing has first and second recesses intersecting opposite sides of the lock cavity and each defining spaced walls disposed perpendicular to said one side of the housing and engageable with the respective ends of the actuator arm for guiding the actuator arm during tilting movement thereof.

8. A lock according to claim 1 wherein said lock housing has a face plate attached thereto at said one side thereof, said housing flanges comprising opposite edge portions of said face plate extending outwardly of the adjacent side wall portions of the lock housing.

9. A lock for use on by-passing type doors to lock the doors in a closed position with adjacent end portions to the doors in spaced overlapping relation, the lock comprising, an elongated keeper plate, means for mounting the keeper plate on one face of that door, a pair of keeper flanges along opposite side edges of the keeper plate projecting inwardly toward each other and spaced from the other side of the keeper plate to define a pair of opposed lengthwise extending grooves at said other side of the keeper plate opening toward each other, means defining a row of stops at said other side of the keeper plate intermediate the keeper flanges, a lock housing formed of an impact resistant synthetic resin material, a metal face plate fixedly attached to the housing at one side thereof and having relatively parallel opposite side edge portions defining a pair of parallel housing flanges fixed to the housing and disposed in a plane at said one side of the housing and projecting outwardly away from each other and dimensioned to be slidably received in the pair of lengthwise extending grooves in the keeper plate to slidably support the housing on the keeper plate, the lock housing being engageable with an edge of the other door when the housing flanges are disposed in the grooves in the keeper plate, latch means at said one side of the housing intermediate said housing flanges and adapted to engage said stops on the keeper plate, a key operated plug mounted for turning only in said lock housing, and means responsive to turning of said key operated plug for moving said latch means relative to said housing flanges in a direction transverse to the plate thereof between a latch position for engaging the stops and a release position for disengaging the stops.

10. A lock according to claim 9 including a lock housing retainer comprising an elongated flexible element having first and second mounting pads attached to opposite ends, each mounting pad having a mounting face and a pressure sensitive adhesive on one mounting face, one of said mounting pads being adapted to be adhesively bonded to the lock housing and the other of the mounting pads being adapted to be adhesively bonded to said other of said doors to retain the lock housing on said other of said doors when it is removed from the keeper plate.

11. A lock for use on by-passing type closure doors to lock the doors in a closed position with adjacent end portions of the doors in spaced overlapping relation, the lock comprising, an elongated keeper member having means defining a row of stops therealong, means for mounting the keeper member on one of the doors, a lock housing having guide means at one side thereof for guidably engaging said keeper member, said lock housing having a plug bore therein disposed perpendicular to said one side of the housing and a lock cavity at the inner end of the plug bore, a key operated plug turnable in said plug bore, a latch comprising a generally U-shaped spring member having an elongated latch arm and an elongated actuator arm integrally interconnected at one end by a bight portion, means mounting the U-shaped spring member in the lock cavity with the actuator arm extending crosswise of the axis of the plug bore adjacent the inner end of the key operated plug and with the latch arm extending crosswise of the axis of the plug bore and spaced relatively farther from the inner end of the key operated plug, said means mounting the U-shaped spring member in lock cavity including means mounting the latch arm on the housing for rocking movement about an axis intermediate the ends of the latch arm and crosswise of plane through the latch and actuator arms, and cam means on the end of the key operated plug engageable with the actuator arm for tilting the actuator arm in response in turning of the key operated plug.

12. A lock according to claim 11 wherein said cam means has a face inclined on an acute angle to the axis of the key operated plug.

13. A lock according to claim 12 including a disk interposed between the actuator arm and the cam means on the plug to allow relative rotation therebetween.

14. A lock according to claim 11 wherein the lock cavity includes first and second recesses at opposite sides of the lock cavity and each defining a pair of opposed guide walls disposed perpendicular to said one face of the lock housing and guidably engaging a respective end portion of the actuator arm.

15. A lock according to claim 11 wherein said lock cavity has a cross-section larger than said plug bore to define a shoulder therebetween, said cam means on the inner end of the key operated plug having a diameter larger than said plug bore and being engageable with said shoulder to prevent withdrawal of the key operated plug from the plug bore.

16. A lock according to claim 11 including a face plate attached to said one side of said lock housing and overlying said lock cavity, said plate having an opening therethrough to allow the free end portion of the latch arm to move therethrough, said means mounting the latch arm on the housing comprising fulcrum means on said plate engageable with said latch arm intermediate its ends.

17. A lock according to claim 16 wherein said face plate has guided flanges at opposite sides of said opening and extending into said cavity at opposite sides of said free end portion of the latch arm to guide the latter during movement through said opening.

18. A lock according to claim 16 wherein said keeper member comprises an elongated keeper plate having a pair of keeper flanges along opposite side edges projecting inwardly toward each other and spaced from one side of the keeper plate to define a pair of opposed lengthwise extending grooves at the other side of the keeper plate opening toward each other, said row of stops being in said keeper plate intermediate the keeper flanges, said guide means on the lock housing comprising opposite edge portions of said face plate extending outwardly of the adjacent side wall portions of the lock housing and into said grooves on the keeper member.

19. In a lock for use on by-passing type closure doors to lock the doors in a closed position with adjacent end portions of the doors in spaced overlapping relation, the lock including an elongated keeper member having means defining a row of stops therealong, means for mounting the keeper member on one of the doors, a lock housing having guide means at one side thereof for guidably engaging the keeper member, latch means on said housing adapted to engage said stops on the keeper member, a key operated plug mounted for turning in said lock housing, means responsive to turning of said key operated plug for moving said latch means between a latch position for engaging the stops and a release position for disengaging the stops, the improvement comprising a lock housing retainer including an elongated flexible element having first and second mounting pads attached to opposite ends, each mounting pad having a mounting face and a pressure sensitive adhesive on the mounting face, one of the pads being adapted to be adhesively bonded to lock housing and the other of said mounting pads being adapted to be bonded to the other of said doors to retain the lock housing on said other of said doors when it is removed from the keeper member.

* * * * *

UNITED STATES PATENT AND TRADEMARK OFFICE

CERTIFICATE OF CORRECTION

PATENT NO. : 4,356,580

DATED : November 2, 1982

INVENTOR(S) : Thomas D. Kurtz

It is certified that error appears in the above-identified patent and that said Letters Patent are hereby corrected as shown below:

Claim 11, column 8, line 35, "in" (second occurrence) should be -- to --.

Claim 17, column 8, line 65, "guided" should be -- guide --.

Signed and Sealed this

Fourth Day of January 1983

[SEAL]

*Attest:*

GERALD J. MOSSINGHOFF

*Attesting Officer*

*Commissioner of Patents and Trademarks*